US012622456B2

(12) United States Patent
Xu et al.

(10) Patent No.: US 12,622,456 B2
(45) Date of Patent: May 12, 2026

(54) HEAT-NOT-BURN PRODUCT AND MANUFACTURING METHOD THEREOF

(71) Applicant: CCOBATO (SHENZHEN) TECHNOLOGY LTD, Shenzhen (CN)

(72) Inventors: Zhixiong Xu, Shenzhen (CN); Yong Zhang, Shenzhen (CN); Yongyang Shen, Shenzhen (CN); Dongwei Kong, Shenzhen (CN)

(73) Assignee: CCOBATO (SHENZHEN) TECHNOLOGY LTD, Shenzhen (CN)

( * ) Notice: Subject to any disclaimer, the term of this patent is extended or adjusted under 35 U.S.C. 154(b) by 554 days.

(21) Appl. No.: 17/642,022

(22) PCT Filed: Sep. 29, 2020

(86) PCT No.: PCT/CN2020/118941

§ 371 (c)(1),
(2) Date: Mar. 10, 2022

(87) PCT Pub. No.: WO2021/068806

PCT Pub. Date: Apr. 15, 2021

(65) Prior Publication Data

US 2024/0041098 A1 Feb. 8, 2024

Related U.S. Application Data

(63) Continuation of application No. PCT/CN2020/082510, filed on Mar. 31, 2020.

(30) Foreign Application Priority Data

Oct. 11, 2019 (CN) ..... 201910965220.0

(51) Int. Cl.
*A24D 1/20* (2020.01)
*A24B 15/167* (2020.01)
*A24B 15/30* (2006.01)

(52) U.S. Cl.
CPC ..... *A24D 1/20* (2020.01); *A24B 15/167* (2016.11); *A24B 15/303* (2013.01)

(58) Field of Classification Search
None
See application file for complete search history.

(56) References Cited

U.S. PATENT DOCUMENTS 2,124,012 A * 7/1938 Smith, Jr. ..... A24B 3/18 131/299
4,186,756 A * 2/1980 Takemoto ..... A24B 15/14 131/369
5,443,560 A * 8/1995 Deevi ..... C09K 5/16 131/359
5,690,127 A * 11/1997 Chapman ..... A24D 1/00 131/360
2014/0202479 A1* 7/2014 Nicholls ..... A24D 3/048 131/337

FOREIGN PATENT DOCUMENTS

CN 104366687 B * 3/2016 ..... A24B 15/12
CN 109730368 A * 5/2019
GB 2078087 A * 1/1982 ..... A24C 5/00

OTHER PUBLICATIONS

Jones et al., Presentation Abstract, "Opportunities for the use of RF heating in the tobacco industry", Coresta Meeting, Smoke/Technology, Innsbruck, 1999, available at https://www.coresta.org/abstracts/opportunities-use-rf-heating-tobacco-industry-5765. html, accessed Aug. 8, 2024. (Year: 2024).*
EPO Machine Translation of CN 104366687 B (published Mar. 16, 2016), 2024. (Year: 2024).*
EPO Machine Translation of CN 109730368 A (published May 10, 2019), 2024. (Year: 2024).*

* cited by examiner

*Primary Examiner* — Dionne W. Mayes
(74) *Attorney, Agent, or Firm* — WPAT, PC

(57) ABSTRACT

The present disclosure relates to a heat-not-burn product and manufacturing method thereof. The method comprises the following steps: providing a hollow tube, plant material, aerosol-forming agent and water; mixing the plant material, aerosol-forming agent and water into paste; inject the paste into the hollow tube from one end of the hollow tube by extrusion; heating the paste in a microwave device or high-frequency device to obtain the expanded and fermented product; drying the product, so that the paste is formed into a loose porous structure with a porosity of 40%-75% in the hollow tube and is formed integrally with the hollow tube, and the water content of the product is between 5 wt. %-10 wt. %; and disposing a filter at the other end of the hollow tube to make the heat-not-burn product. Using the microwave or high-frequency wave can simultaneously heat the inside and outside paste of the product, and meanwhile shorten the heating time to achieve the effect of uniform heating without any heat conduction process.

11 Claims, 8 Drawing Sheets

HEAT-NOT-BURN PRODUCT AND MANUFACTURING METHOD THEREOF

BACKGROUND

Technical Field

The present disclosure relates to a field of the aerosol-generating product, and more particularly to a heat-not-burn aerosol-generating product and manufacturing method thereof.

Related Art

At present, heat-not-burn and other new non-tobacco and tobacco products are the developing trend. However, the manufacturing method of the heat-not-burn non-tobacco and tobacco products on the market is complex. The products which are needed more manufacturing devices to manufacture consume quite a lot of manpower and financial resources. Most aerosol-generating article are adopted the shapes of filament, sheet or granule so that the suction effect is bad. For example, the suction resistance of the aerosol-generating article is larger or smaller and the generating aerosol volume is small, when a smoker use a heater to heat the heat-not-burn product.

The existing aerosol-generating article is usually adopted the shape of filament, sheet or granular. Therefore, the aerosol-generating article is usually needed to be manually filled into a smoke tube, which is inconvenient to operate and not easy to control the filling amount. Even if the filling is mechanical operation, it will be also difficult to control the filling operation. The automatic machine will be very complex, which is difficult to control the filling operation and achieve the consistently filling quantity.

SUMMARY

In order to solve the problems existing in the prior art, the present disclosure provides a manufacturing method of a heat-not-burn product. The manufacturing method comprises the following steps: providing a hollow tube, plant material, aerosol-forming agent and water; mixing the plant material, aerosol-forming agent and water into paste; injecting the paste into the hollow tube from one end of the hollow tube by extrusion; heating the paste in a microwave device or in a high-frequency device to obtain the expanded and fermented product; drying the product, so that the paste is formed into a loose porous structure with a porosity of 40%-75% in the hollow tube and is formed integrally with the hollow tube, and the water content of the paste is between 5 wt. %-10 wt. %; and disposing a filter at the other end of the hollow tube to make the heat-not-burn product.

Preferably, the paste in the hollow tube accounts for 10%-100% of the length of the hollow tube.

Preferably, heating power provided by the microwave device is 1 KW-100 KW, and heating temperature provided by the microwave device is 30° C.-80° C. and heating time provided by the microwave device is 30-180 minutes.

Preferably, heating frequency provided by the high-frequency device is 1 MHz-30 MHz, and heating temperature provided by the high-frequency device is 30° C.-80° C. and heating time provided by the high-frequency device is 30-180 minutes.

Preferably, the heating process of the microwave device or the high-frequency device is carried out in a situation of vacuum.

Preferably, drying temperature in the drying step is 40° C.-80° C., and drying time is 100-400 minutes.

Preferably, the paste comprises 30-80 parts by weight of plant material, 5-10 parts by weight of tobacco spice, 5-20 parts by weigh of tobacco extract, 5-50 parts by weight of aerosol-forming agent, 0.01-5 parts by weight of adhesive, 0.01-1 parts by weight of expansion agent and 10-60 parts by weight of water.

Preferably, the plant material is crushed in advance so that the powder particle size of the plant material is 40-200 mesh.

Preferably, the capsule support and the capsule filled with spice is disposed in sequence before the filter is disposed. The capsule support is installed along the center line of the paste and in contact with the paste. One end of the capsule is in contact with the capsule support and the other end of the capsule is in contact with the filter.

Preferably, the capsule support is a coiled column shaped by winding a sheet. A plurality of layers are formed in the process of winding the sheet. There is a gap between the layers and the diameter of the capsule support is less than the inner diameter of the hollow tube.

Preferably, a hollow filter and a capsule filled with spice are disposed in sequence before the filter is disposed. The hollow filter is installed along the center line of the paste and in contact with the paste. The hollow filter, the capsule and the filter are disposed in sequence. The inner diameter of the hollow filter is less than the outer diameter of the capsule, so that the capsule is secured between the hollow filter and the filter.

In order to solve the problems existing in the prior art, the present disclosure further provides a heat-not-burn product. The heat-not-burn product comprises a hollow tube and paste. The paste is made by mixing plant material, aerosol-forming agent and water. The paste is extruded into one end of the hollow tube through an extrusion device, and then heated by microwave in a microwave device or by high-frequency wave in a high-frequency device to expand and ferment.

Preferably, the paste comprises 30-80 parts by weight of plant material, 5-10 parts by weight of tobacco spice, 5-20 parts by weigh of tobacco extract, 5-50 parts by weight of aerosol-forming agent, 0.01-5 parts by weight of adhesive, 0.01-1 parts by weight of expansion agent and 10-60 parts by weight of water.

Preferably, heating power provided by the microwave device is 10 KW-20 KW, and heating temperature is 45° C.-60° C. and heating time is 30-80 minutes.

Preferably, heating frequency provided by the high-frequency device is 5 MHz-15 MHz, and heating temperature is 45° C.-60° C. and heating time is 30-80 minutes.

Preferably, the drying device in the drying step is a low-temperature oven with 40° C.-80° C. of drying temperature and 100-400 minutes of drying time.

Preferably, the drying temperature of the drying device is 50° C.-60° C. and the drying time is 180-280 minutes.

Preferably, the paste is formed integrally with the inner wall of the hollow tube, and the paste is a loose column with a porosity of 40-75%.

Preferably, the water content is 5 wt. %-10 wt. % of the paste.

Preferably, the heat-not-burn product further comprises a capsule support, a capsule filled with spice and a filter. The capsule support, the capsule and the filter are installed into the hollow tube in sequence. The capsule support is installed along the center line of the paste and in contact with the paste, and one end of the capsule is in contact with the capsule support and the other end of the capsule is in contact with the filter.

Preferably, the capsule support is a coiled column formed by winding a sheet. A plurality of layers are formed in the process of winding the sheet. There is a gap between the layers and the diameter of the capsule support is less than the inner diameter of the hollow tube.

Preferably, the material of the capsule support is a loose structure with spiral cross section formed by winding paper, high temperature resistant film, aluminum foil, tin foil or polylactic acid sheet. The diameter of the capsule support is 1-9 mm, the length of the capsule support is 3-30 mm and the gap of the capsule support is 0.1-1.5 mm.

Preferably, the capsule support is a hollow filter.

Preferably, the inner diameter of the hollow filter is smaller than the outer diameter of the capsule.

Preferably, the capsule is a spherical and brittle capsule containing liquid perfume, and the diameter of the spherical and brittle capsule is 2.0-5.0 mm.

Preferably, the capsule comprises a capsule film and a surface layer formed on the surface of the capsule film. The surface layer of the capsule film is sealing layer which is used to prevent the volatilization of spice and maintain the durability of spice.

Preferably, a plastic part is installed between the paste and the capsule support, and one end of the plastic part is in contact with the paste and the other end of the plastic part is in contact with the capsule support to secure the capsule.

Compared with the prior art, there are at least following advantages of the product of the present disclosure:

1. Microwave or high-frequency wave has the characteristic of strong penetrability through substances. Therefore, using the microwave or high-frequency wave can simultaneously heat the inside and outside paste of the product, and meanwhile shorten the heating time to achieve the effect of uniform heating without any heat conduction process. In the situation of vacuum, the microwave or high-frequency wave can heat the paste to eliminate the its peculiar smell and make its taste soft. The paste is heated and formed together with the hollow tube. The produced product has a loose porous structure and suitable suction resistance, which the paste can be easily inserted into a heater to improve the users' experience. In addition, the microwave or high-frequency wave heating has a good germicidal effect.
2. Using the microwave device or the high-frequency device has the advantages of small covering area and simple operation. It not only reduces the overall manufacturing cost, but also avoids a high-temperature environment. The present disclosure also has the advantages of no pollution and saving energy, and makes the products not easy to deteriorate and mildew and then conducive to long-term storage.
3. The suction resistance of the heat-not-burn non-tobacco or tobacco product is between 0.75-1.5 Kpa, which is consistent with the suction resistance of traditional light cigarettes, so that the heat-not-burn product can provide good suction resistance.
4. The heat-not-burn non-tobacco or tobacco product is smoked by heating at 200-300° C. When heated at 200-300° C., herbal material, traditional Chinese medicine or tobacco material will not decompose to tar and other harmful substances and be beneficial to physical and mental health.
5. Due to the water content in the paste accounts for 5 wt. %-10 wt. % and is low, the temperature of the aerosol generated by heating the paste through a heater is low and will not burn the user's mouth. At the same time, the liquid spice in the capsule can replenish aerosol flavor to the aerosol generated by heating the paste, which can pleasure the user.
6. A impermeable label is adhered on the surface of the heat-not-burn product of the present disclosure, which can prevent the paste from absorbing moisture in the air and becoming wet, and it will not cause the product to breed bacteria or mildew, and keep the product clean entirely.

On the advantages and the spirit of the present disclosure, it can be understood further by the following invention descriptions and attached drawings.

BRIEF DESCRIPTION OF THE DRAWINGS

In order to more clearly explain the embodiment of the present disclosure or the technical scheme in the prior art, the following will briefly introduce the attached drawings that need to be used in the embodiment. It is obvious that the attached drawings in the following description are only some embodiments of the present disclosure. For ordinary technicians in the art, without paying creative labor, other drawings can also be obtained from these drawings.

DETAILED DESCRIPTION

The present disclosure will be described below in detail in combination with preferred embodiments and attached drawings as shown in FIG. 1 to FIG. 13.

Figure 1:
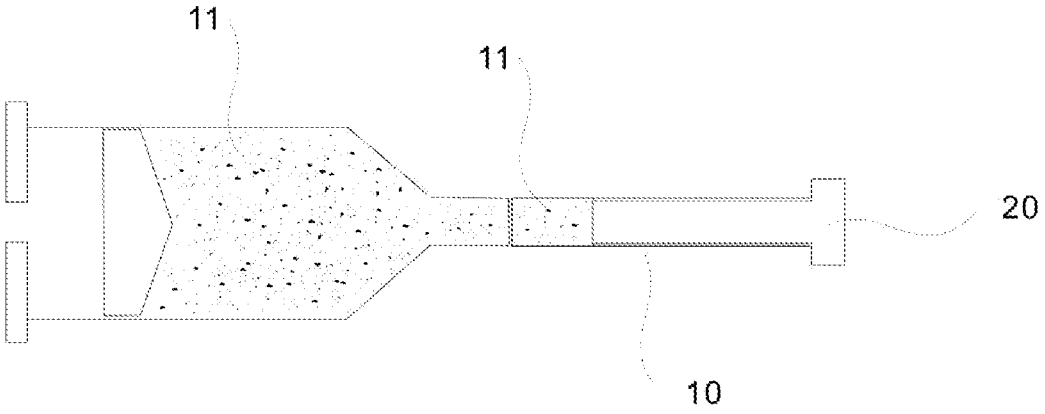
FIG. 1 illustrates a structural diagram of extruding into hollow tube in a manufacturing method of a heat-not-burn product of the present disclosure.
Figure 2:
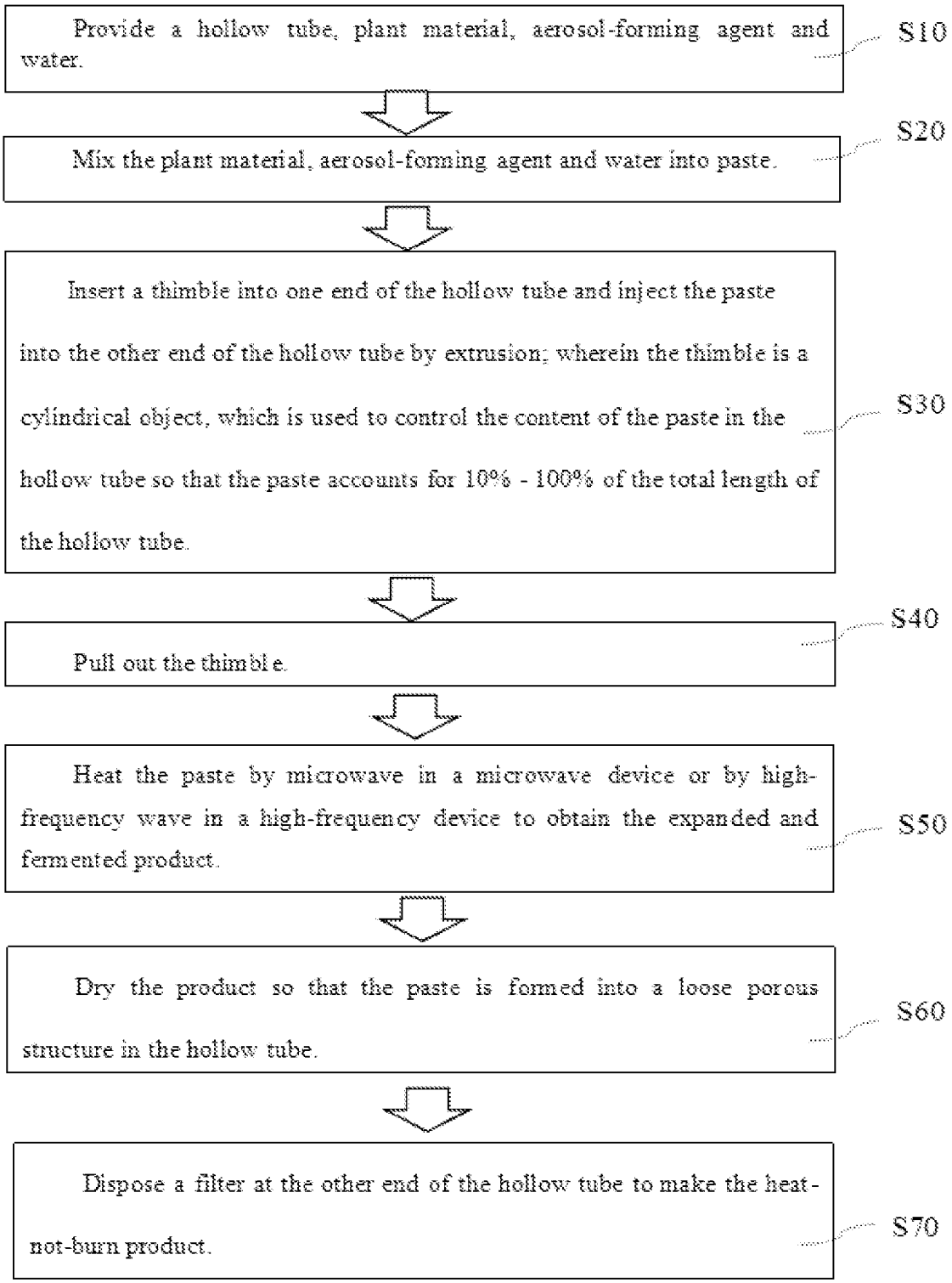
FIG. 2 illustrates the process flow chart of the manufacturing method of the heat-not-burn product of the present disclosure.
Figure 3:
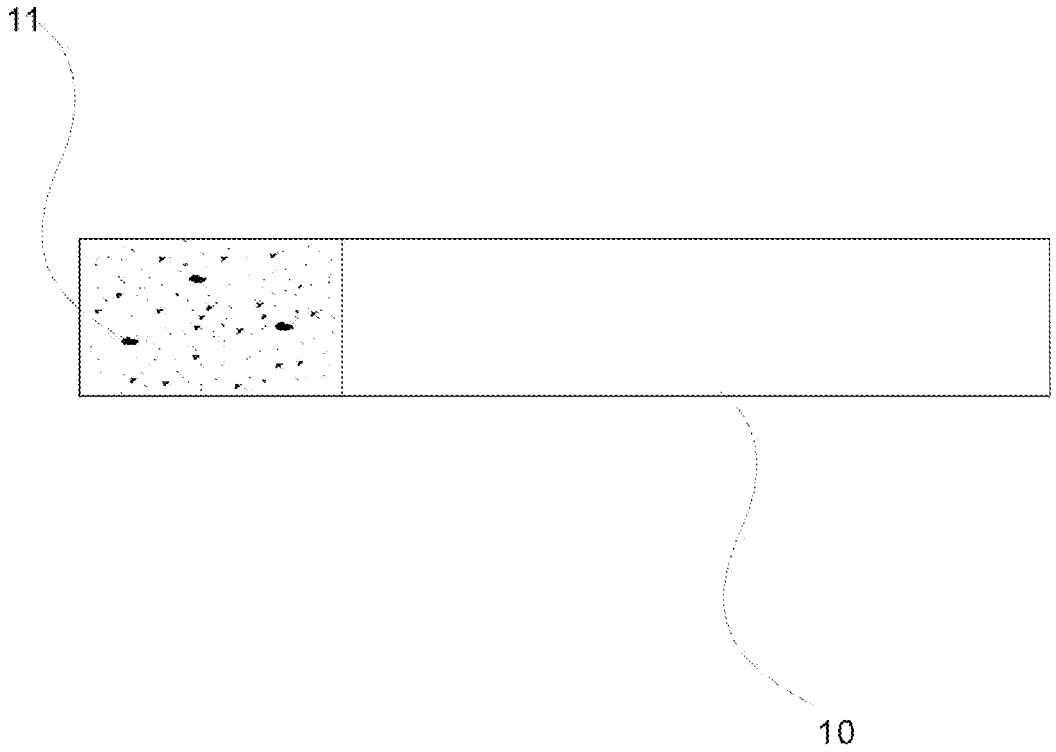
FIG. 3 illustrates a heat-not-burn product obtained in the manufacturing method of FIG. 2.

Please refer to FIG. 1 to FIG. 3. FIG. 1 illustrates a structural diagram of extruding into hollow tube in a manufacturing method of the heat-not-burn product of the present disclosure. FIG. 2 illustrates the process flow chart of the manufacturing method of the heat-not-burn product of the present disclosure. FIG. 3 illustrates a heat-not-burn product obtained in the manufacturing method of FIG. 2. The manufacturing method of the heat-not-burn product according to an embodiment of the present disclosure mainly comprises the following steps:

Step S10: firstly, providing a hollow tube 10, plant material, aerosol-forming agent and water; Step S20: mixing the plant material, aerosol-forming agent and water into the paste 11;

Step S30: inserting a thimble 20 into one end of the hollow tube 10 and inject the paste 11 into the other end of the hollow tube 10 by extrusion; wherein the thimble 20 is a cylindrical object, which is used to control the content of the paste 11 in the hollow tube 10 so that the paste 11 in the hollow tube accounts for 10%-100% of the total length of the hollow tube 10;

Step S40: pulling out the thimble 20;

Step S50: heating the paste 11 in a microwave device or in a high-frequency device to obtain the expanded and fermented product;

Step S60: drying the product, so that the paste 11 is formed into a loose porous structure with a porosity of 40-75% in the hollow tube 10, and the paste 11 through expansion is formed integrally with the inner wall of the hollow tube 10; and Step S70: finally, disposing a filter 12 at the other end of the hollow tube 10 to make the heat-not-burn product.

The embodiments of the present disclosure specifically relates to a manufacturing method of the heat-not-burn product and the heat-not-burn product are described in the following instructions.

As shown in FIG. 1 to FIG. 3, in step S10, the hollow tube 10 of the present disclosure can be a hard paper tube, an aluminum foil paper tube, a tin foil paper tube, or a high-temperature resistant plastic tube or a high-temperature resistant silicone tube, which provides the hardness required by the embodiment of the present disclosure. As shown in FIG. 1, this embodiment takes the hard paper tube as an example. Firstly cut the materials of the hard paper tube into the hollow tube 10 with a predetermined length. The length of the hollow tube 10 is 30-60 mm, preferably 45 mm, and the wall thickness of the hollow tube 10 is 0.2-0.5 mm, preferably 0.35-0.45 mm. Then insert the thimble 20 with a predetermined length; for example, insert a stainless steel thimble with a length of 30 mm into the hollow tube 10 to form a hollow space 13 with a length of 10-30 mm; preferably a hollow space 13 with a length of 12-18 mm. FIG. 1 shows that the thimble 20 is inserted when the hollow tube 10 is ready. In other embodiments, insert the thimble 20 into the hollow tube 10 after the paste 11 mixed with the plant material, aerosol-forming agent and water is injected into the hollow tube 10. Then, extrude the excess paste 11 out of the hollow tube 10 by the thimble 20. At the same time, remove the extra paste 11 at the end of the hollow tube 10 and then pull out the thimble 20.

In some embodiments, the plant material is firstly ground into powder, and the size of the powder particle is preferably 40-200 mesh. Preferably, the size of the powder particle is 100 mesh. The paste 11 is mixed with the powder of the plant material, aerosol-forming agent, tobacco spice and water according to a predetermined ratio. In other embodiments, a small proportion of adhesive and expansion agent can also be added. Preferably, the plant material is one or more compositions selected from herbal materials, traditional Chinese medicines, herbal material extracts, tobacco materials, tobacco material extracts.

In some embodiments, the herbal material and herbal material extract is one or more compositions selected from tea, lotus leaf, mint, licorice, clove, gynostemma pentaphyllum, ginkgo leaf, guava, wolfberry, mulberry leaf, basil, jasmine flower, buckwheat tea, dandelion tea, *Houttuynia cordata*, dried lemon, apple, banana, dried orange, pineapple, mango, cantaloupe, *Passiflora eduli, chrysanthemum*, star anise, osmanthus, mulberry leaf, bay leaf, *perilla*, orange, *Angelica dahurica*, amomum tsao-ko, tangerine peel, lavender, hawthorn, rose, honeysuckle, tartary buckwheat tea, chestnut, ilibiscus, lily, *Lysimachia foenum-graecum* hance, spikenard, *Abrus cantoniensis*, banksia rose, sandalwood, agarwood, coffee, blueberry, strawberry, hazelnut, rosemary, *Cymbopogon citratu*, Queensland fruit, walnut, almond, lacquer tree fruit, Brazil nut, cocoa bean, nutmeg, *betel* nut, wooden pulp, plant fiber.

In some embodiments, the traditional Chinese medicine is one or more compositions selected from radix rehmanniae, prepared rehmannia root, *Angelica sinensis, cassia* seed, dandelion, *Apocynum venetum*, jujube, medlar, *Fritillaria cirrhosa, Panax notoginseng, Sterculia scaphigera*, borneol, menthol, saffron, *poria, pueraria, Dalbergia odorifera*, holy basil, *perilla* leaves, bupleurum, isatis root, *astragalus*, prunella vulgaris, *ginseng*, white peony, *Gastrodia elata, Schisandra chinensis, chrysanthemum* and plantain.

In some embodiments, the tobacco material comprises tobacco leaf and tobacco stem, and the tobacco material is raw or processed.

In some embodiments, the tobacco material extract is one or more compositions selected from Zimbabwe tobacco extract, burley tobacco extract, Greek tobacco extract, Yunnan tobacco extract, American tobacco extract, Virginia tobacco extract, sunburned tobacco extract, tamarind fruit extract, oriental tobacco extract, nicotine and nicotine salt.

In some embodiments, the aerosol-forming agent is one or more compositions selected from propylene glycol, glycerol, triethylene glycol diacetate, glycerol triacetate, triethyl citrate, isopropyl myristate, methyl stearate and glycerol monooctanoate. Preferably, it is selected from one or more compositions of propylene glycol and glycerol.

In some embodiments, the tobacco spice is one or more compositions selected from peppermint oil, menthol, rose oil, vanilla extract, chocolate spiceing, cocoa extract, cinnamyl cinnamate, star anise oil, gamma-octanoic lactone, lemon oil, agarwood oil, ethyl maltol, methyl cyclopentenolone, 2-acetylpyrazine, 2,3,5-trimethylpyrazine and cinnamon leaf oil.

In some embodiments, the adhesive is one or more compositions selected from gelatin, xanthan gum, corn starch, agar, pectin, amorphophallus campanulatus, carrageenan and microcrystalline cellulose.

In some embodiments, the expansion agent is one or more compositions selected from carboxymethyl cellulose sodium salt, carboxyethyl cellulose sodium salt and microcrystalline cellulose.

In some embodiments, Preferably, the paste comprises 30-80 parts by weight of plant material, 5-10 parts by weight of tobacco spice, 5-20 parts by weigh of tobacco extract, 5-50 parts by weight of aerosol-forming agent, 0.01-5 parts by weight of adhesive, 0.01-1 parts by weight of expansion agent and 10-60 parts by weight of water. Because the expansion agent has the expandable function, it can combine with water to expand when the paste is mixed, so that the volume of the paste is increased and the hardness of the paste is reduced. As the present disclosure adopts a microwave device or a high-frequency device as a heating device, the water content of the mixed paste of the present disclosure is more than that of the prior art and the preferred water content is 35-60 parts by weight.

In step S20, since more than 35 parts by weight of water is selected in this embodiment, the paste 11 mixed with the above materials can have good fluidity. The water in this content range can make the compositions form a whole like clay, which is easy to agglomerate and combine relatively tightly. After the subsequent drying step, the water will volatilize and the paste 11 will form small pores. If there is too little water, the paste 11 will not be easy to be extruded into a long strip; and too much water is not conducive to the solidification of the paste 11. On the other hand, in the subsequent heating process in a microwave or high-frequency device to expand and ferment, and the low-temperature drying process, the water is evaporated to obtain the paste with appropriate porosity. In addition, in the mixing process of the paste 11, the paste can be properly stirred, and then the expansion effect of the paste can be better.

In step S30, as shown in FIG. 1, the hollow tube 10 has two opposite ends. Before extrusion, insert the thimble 20 from one end of the hollow tube 10 and form the hollow space 13 between the end of the thimble 20 in the hollow tube 10 and the other end of the hollow tube 10. Preferably, the length of the hollow space 13 is 12-18 mm. The paste 11 can be expanded and fermented better when the paste 11 has a certain length in the hollow tube 10. If the length is lower than 12 mm, the fermentation effect will be not good; if it is longer than 18 mm, the drying time of the paste 11 will be long, which affects the economic benefit and the suction resistance when the product is used. Therefore, the better length of the paste 11 is 12.00-15 mm, and an user obtains the best suction resistance.

Further, the outer diameter of the thimble 20 is smaller than the inner diameter of the hollow tube 10, and the length of the thimble 20 in the hollow tube 10 is smaller than that of the hollow tube 10. During extrusion, the mixed paste 11 is extruded into the hollow space 13 from the other end of the hollow space 13 away from the thimble 20 by extrusion; the pressure and time of the extrusion are controlled to confirm that the paste 11 is filled in the hollow space 13 and is formed with the hollow tube 10, and then the thimble 20 is pulled out to complete the step S40 as shown in FIG. 3.

In this embodiment, preferably, the mixed paste 11 is extruded into the hollow space 13 of the hollow tube 10 by means of air pressure, hydraulic pressure or mechanical pressure until the paste 11 is in contact with the thimble 20 in the hollow tube 10, and is formed integrally with the hollow tube 10. Then, the thimble 20 is pulled out from the hollow tube 10 to obtain the heat-not-burn product of the present disclosure.

In another embodiment, when the paste 11 is extruded into the hollow tube 10 by mechanical means, the mechanical means is adopted the motor spiral driven injection device; wherein the motor spiral driven injection device includes an extrusion tube, a motor push piston and a motor spiral driven; wherein the paste 11 is loaded into the extrusion tube.

In some embodiments, the extrusion device is a dispensing tube. The dispensing tube is connected to the air pipe through the pneumatic controller, and squeeze the paste in the dispensing tube into the hollow space of the hollow tube 10 by controlling the pneumatic controller until the paste 11 is filled from one end of the hollow tube 10 to the end of the thimble 20. Then the thimble 20 is pulled out and the paste 11 is formed into a column in the hollow tube 10.

The characteristic of the present disclosure is in step S50, which adopts a microwave or high-frequency wave heating method to expand the paste. The characteristic of the strong penetrability of the microwave or high-frequency wave through substances can simultaneously heat the inside and outside paste 11, so that the water in the paste 11 can be heated, vaporized and pressurized rapidly. The method of the microwave or high-frequency wave heating can shorten the heating time to achieve the effect of uniform heating without any heat conduction process.

In this embodiment, in step S50, the microwave device is a microwave oven. The heating power provided by the microwave device is 1 KW-100 KW, the heating temperature provided by the microwave device is 30° C.-80° C., and the heating time provided by the microwave device is 30-180 minutes; preferably. Further, the heating power provided by the microwave device is 10 KW-20 KW, the heating temperature is 45° C.-60° C., and the heating time is 30-80 minutes. In some embodiments, in step S50, the high-frequency device is a high-frequency wave oven. The frequency provided by the high-frequency device is 1 MHz-30 MHz, the heating temperature provided by the high-frequency device is 30° C.-80° C., and the heating time provided by the high-frequency device is 30-180 minutes. Preferably, the heating frequency provided by the high-frequency device is 5 MHz-15 MHz, the heating temperature provided by the high-frequency device is 45° C.-60° C., and the heating time provided by the high-frequency device is 30-80 minutes. In this step, the hollow tube 10 containing the cylindrical paste 11 is put into the microwave oven or high-frequency wave oven, and the material of the paste is expanded to form small pores by microwave or high-frequency wave. Because the paste 11 is expanded inside and outside at the same time, the material of the paste 11 is adhered to the inner wall of the hollow tube 10 and is formed into an integral structure with the hollow tube 10.

In some embodiments, in step S50, the microwave device or high-frequency device is used to carry out the heating process in a situation of vacuum. The paste 11 can ferment in the control of the uniform temperature of the microwave device or the high-frequency device, so that the peculiar smell of the paste can be eliminated and the taste can be soft.

Next, in step S60, the product shown in FIG. 3 is dried after expansion in step S50. In this embodiment, the adopted drying device is a low-temperature oven. The drying temperature is 40-80° C., and the drying time is 100-400 minutes. Preferably, the drying temperature of the drying device is 50-60° C. and the drying time is 180-280 minutes. This drying process is at low temperature. If the drying temperature is too high, the hardness of the paste 11 after dried is too big to be inserted into the heater for smoking. If the drying temperature is too low, the drying time will be too long, which will be not conducive to production efficiency. Specifically, the paste 11 extruded into the hollow tube 10 is heated to expand and ferment by microwave or high-frequency wave and dried at low temperature to obtain the product, and the inner paste is a loose porous structure with a porosity of 40-75%. Within this porosity range, the structure of the paste 11 of the product is neither too soft nor too hard, and the hardness of the paste 11 makes the force of being inserted to the heater for smoking is 0.8-2.0 kgf. In addition, because the product is heated by microwave or high frequency wave and dried at low temperature, the paste 11 is formed integrally with the inner wall of the hollow tube 10 into a loose cylindrical body with a porosity of 40-75%. When inserted into the heater for heating and smoking, the paste 11 fits more closely with the part of the heater and is heated more uniformly, so that a better amount of aerosol can be obtained for smoking. Moreover, the paste 11 with the porosity of 40%-75% can make the aerosol pass smoothly to obtain a suitable suction resistance. The aerosol is generated when the product is inserted into a heater to heat the paste 11, and the suction resistance of the paste in this embodiment is 1.0-1.5 Kpa. Preferably, the water content is 5%-10% by weight of the paste after dried, so that the water vapor content of the paste heated in the heater is small and the temperature of the aerosol is low to avoid burning the user's mouth. Preferably, the temperature of the microwave or high-frequency wave used to heat the product and the temperature used to dry the product don't exceed 50° C. which is not high, so that the loss of tobacco spice in these two steps is low and the taste of the tobacco spice keeps well.

Figure 4:
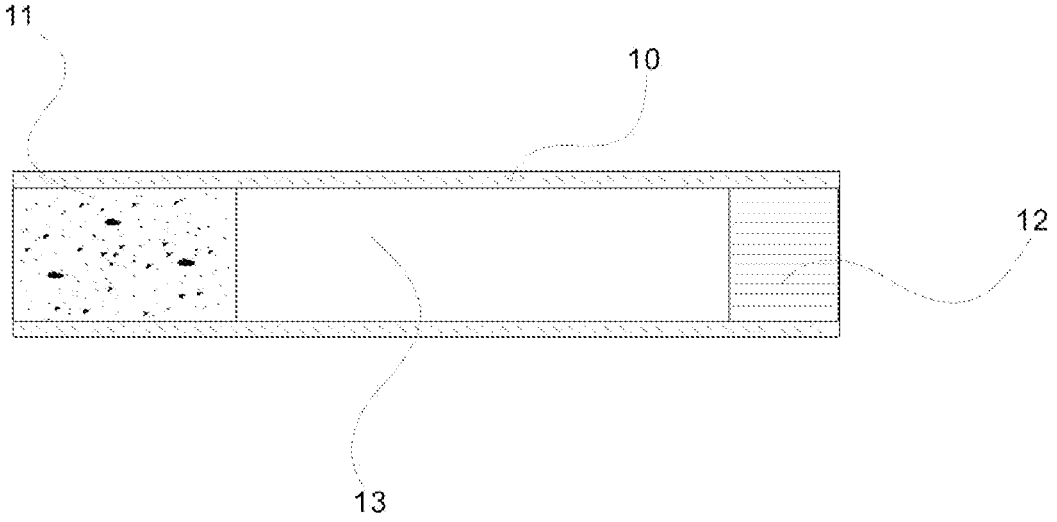
FIG. 4 illustrates another heat-not-burn product obtained in the manufacturing method of FIG. 2.

Finally, in step S70, a filter 12 is disposed at the other end of the hollow tube 10 opposite to the paste 11 to obtain the heat-not-burn product as shown in FIG. 4. Preferably, the filter 12 is a spongy structure for filtering small particles and allowing the aerosol to pass smoothly.

Figure 5:
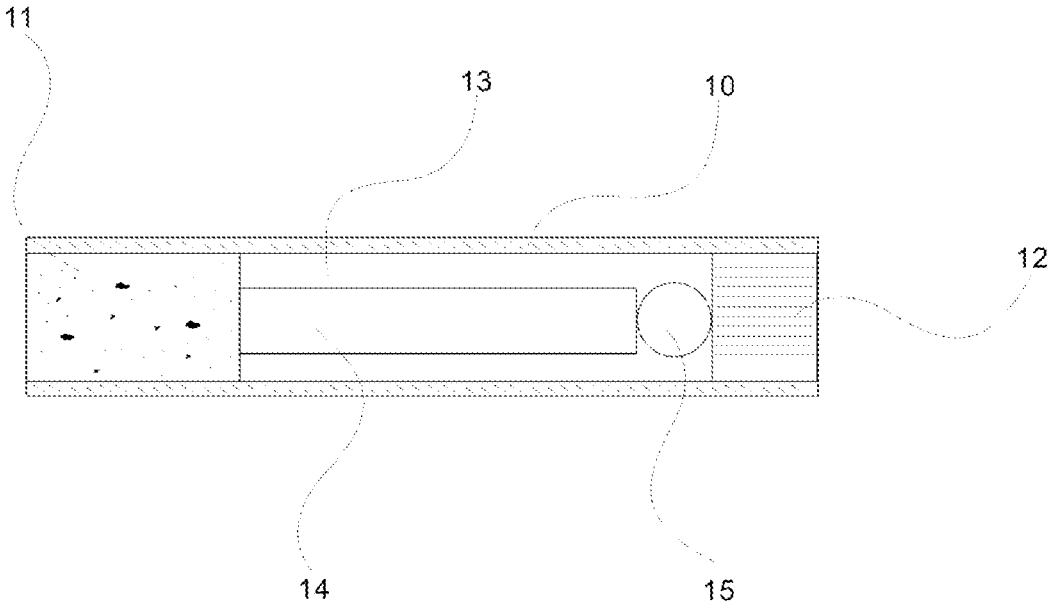
FIG. 5 illustrates a schematic diagram of an embodiment of the heat-not-burn product of the present disclosure.

In some embodiments, other steps can be added between step S60 and step S70 to produce different heat-not-burn products of the present disclosure. Please refer to FIG. 5, which illustrates a schematic diagram of an embodiment of the heat-not-burn product of the present disclosure. As shown in FIG. 5, before setting the filter in step S70, the capsule support 14 and the capsule 15 filled with spice are disposed into the hollow space 13 of the hollow tube 10 in sequence. The capsule support 14 is installed along the central line of the paste 11 and in contact with the paste 11, and one end of the capsule 15 is in contact with the capsule support 14 and the other end of the capsule 15 is in contact with the filter 12.

In this embodiment, the capsule support 14 is a coiled column formed by winding a sheet. A plurality of layers are formed in the process of winding the sheet. There is a gap between the layers and the diameter of the capsule support 14 is less than the inner diameter of the hollow tube 10.

Preferably, the capsule support 14 is a loose structure formed by winding a thin sheet. One end of the capsule support 14 is in contact with the paste 11 and the other end of the capsule support 14 is in contact with the capsule 15 filled with spice, which is used to secure the capsule 15 and reduce the temperature of the aerosol. In other embodiments, the material of the capsule support 14 is a loose structure with spiral cross section formed by winding a piece of paper, high temperature resistant film, aluminum foil, tin foil or polylactic acid sheet. The diameter of the capsule support 14 is 1-9 mm, the length of the capsule support 14 is 3-30 mm and the gap of the capsule support 14 is 0.1-1.5 mm.

Figure 6:
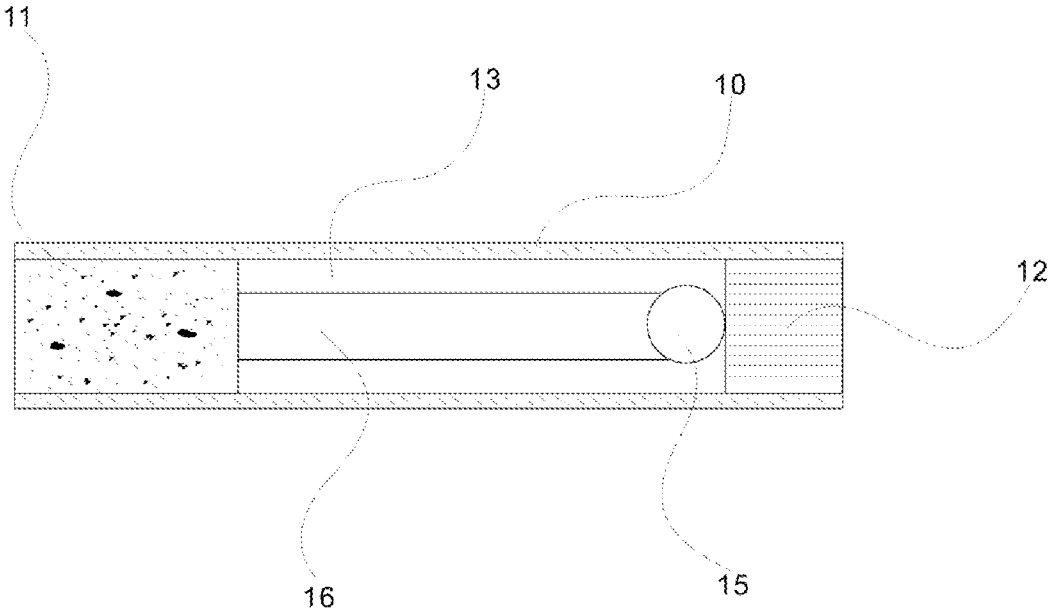
FIG. 6 illustrates a schematic diagram of another embodiment of the heat-not-burn product of the present disclosure.

Please refer to FIG. 6, which FIG. 6 illustrates a schematic diagram of another embodiment of the heat-not-burn product of the present disclosure. As shown in FIG. 6, in this embodiment, the capsule support 16 is a hollow filter. The capsule support 16 and the capsule 15 are installed in sequence through a compound machine. The capsule support 16 is installed along the central line of the paste 11 and in contact with the paste 11. The inner diameter of the hollow filter is less than the outer diameter of the capsule 15, so that the capsule 15 is secured between the hollow filter and the filter 12.

In each embodiment of the present disclosure, the capsule 15 is a spherical and brittle capsule containing liquid spice, and the diameter of the spherical and brittle capsule is 2.0-5.0 mm. Preferably, the capsule 15 comprises a capsule film and a surface layer formed on the surface of the capsule film; wherein the surface layer of the capsule film is sealing layer which is used to prevent the volatilization of the spice and maintain the durability of spice.

Figure 7:
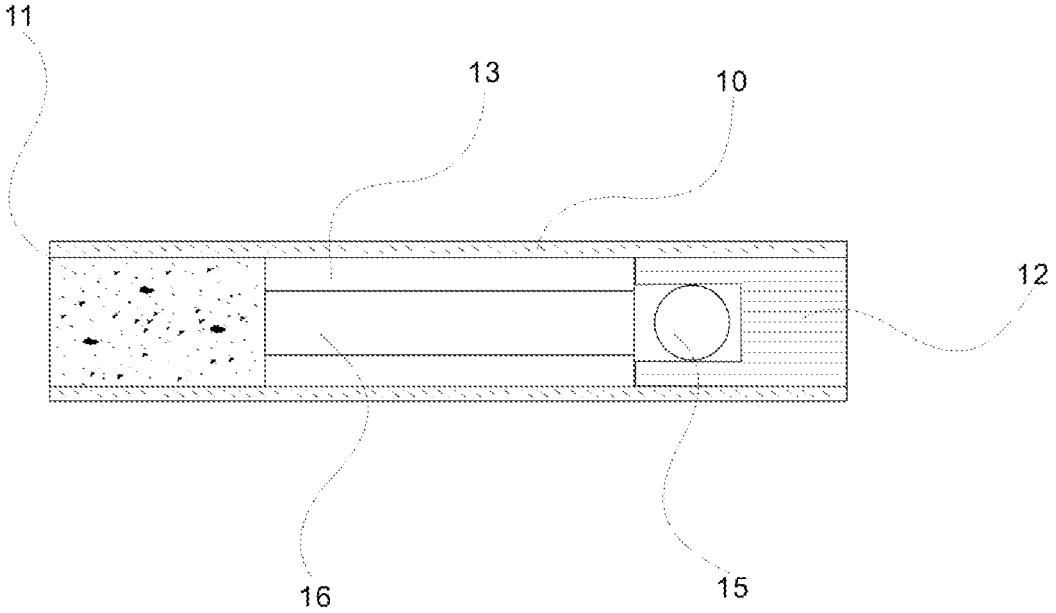
FIG. 7 illustrates a schematic diagram of another embodiment of the heat-not-burn product of the present disclosure.

Please refer to FIG. 7, which illustrates a schematic diagram of another embodiment of the heat-not-burn product of the present disclosure. As shown in FIG. 7, in this embodiment, the capsule support 16 is a hollow filter. The capsule support 16 and the capsule 15 are installed in sequence through the compound machine. The capsule support 16 is installed along the central line of the paste 11 and in contact with the paste 11. The inner diameter of the hollow filter is less than the outer diameter of the capsule 15, so that the capsule 15 is installed in the groove formed in the filter 12. When the product of the present disclosure is smoked, the capsule 15 is more convenient to be crumbed, so that the liquid spice in the capsule 15 overflows with the aerosol into the user's mouth, and the aerosol is generated when the product is heated in a heater to heat the paste 11.

Further, the embodiments of the heat-not-burn product of the present disclosure can be installed with the capsule 15 or not and then the heat-not-burn product is produced to satisfy the choice of consumers.

Figure 8:
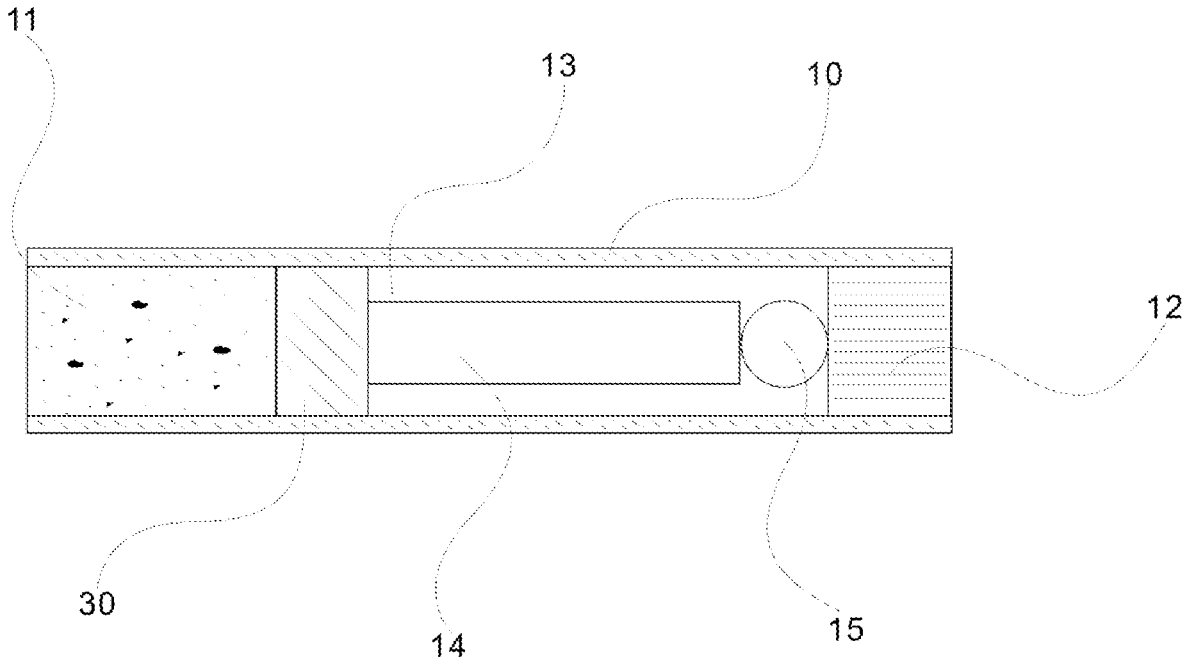
FIG. 8 illustrates a schematic diagram of another embodiment of the heat-not-burn product of the present disclosure.
Figure 9:
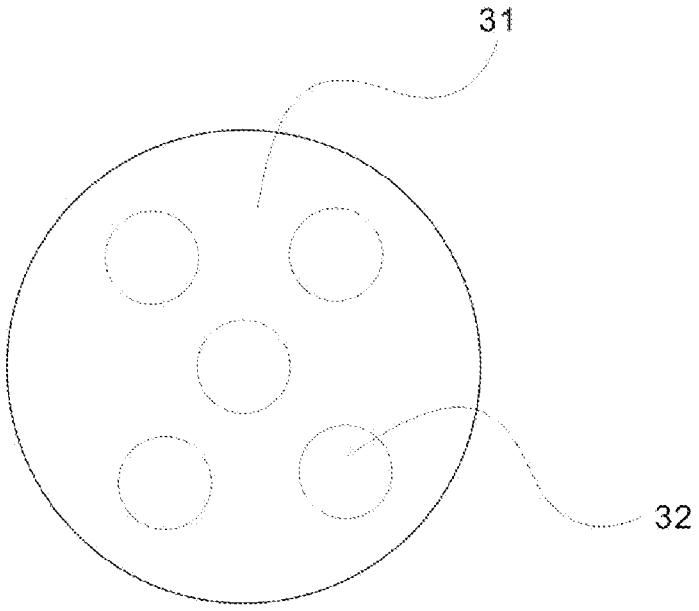
FIG. 9 to FIG. 12 illustrate schematic diagrams of different embodiments of the plastic part of the heat-not-burn product of the present disclosure.
Figure 10:
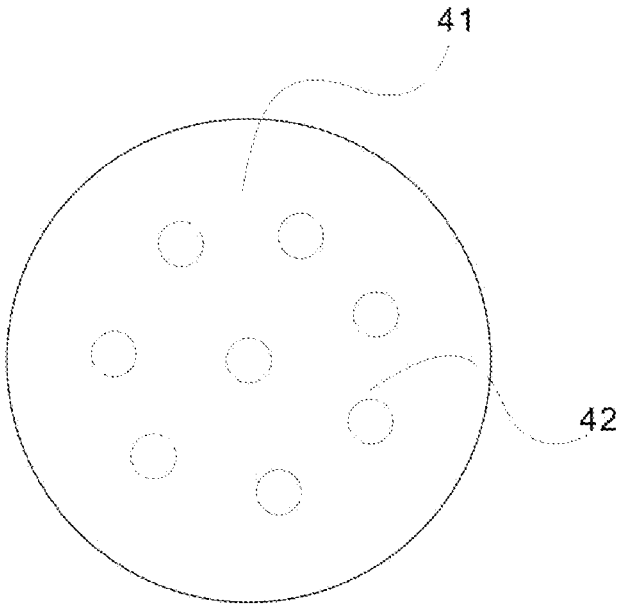
Figure 11:
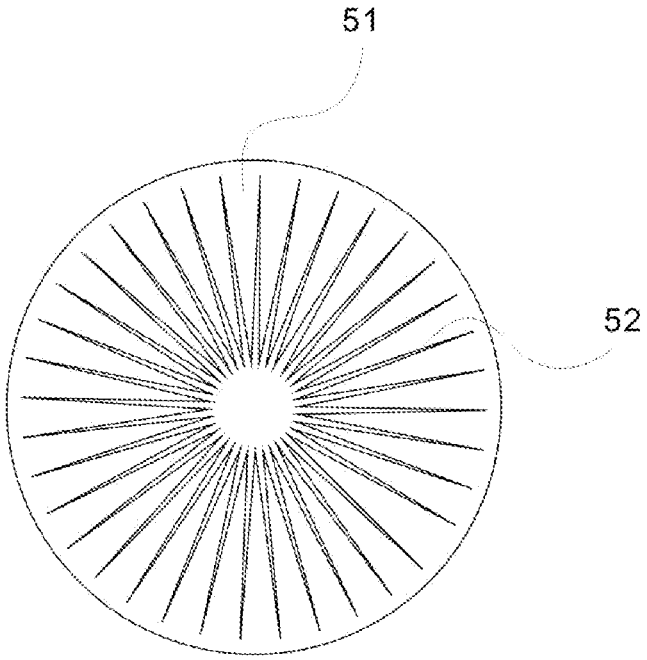
Figure 12:
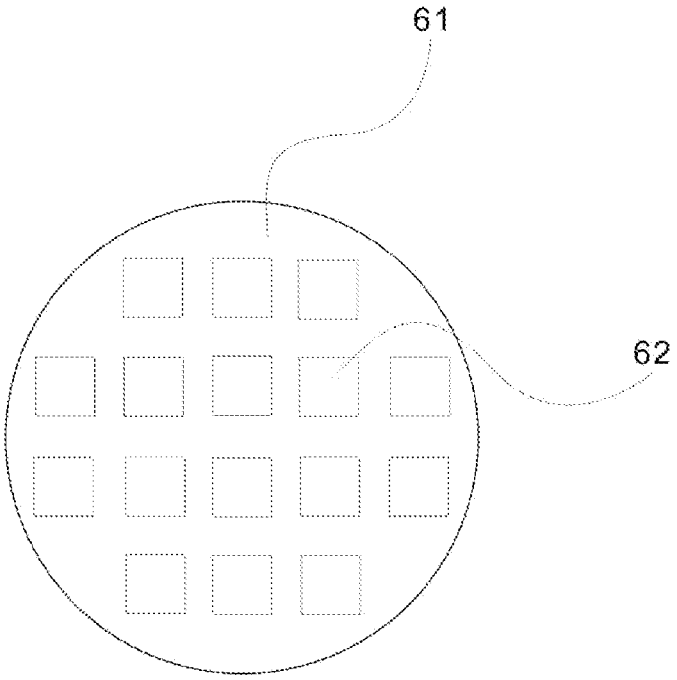
Figure 13:
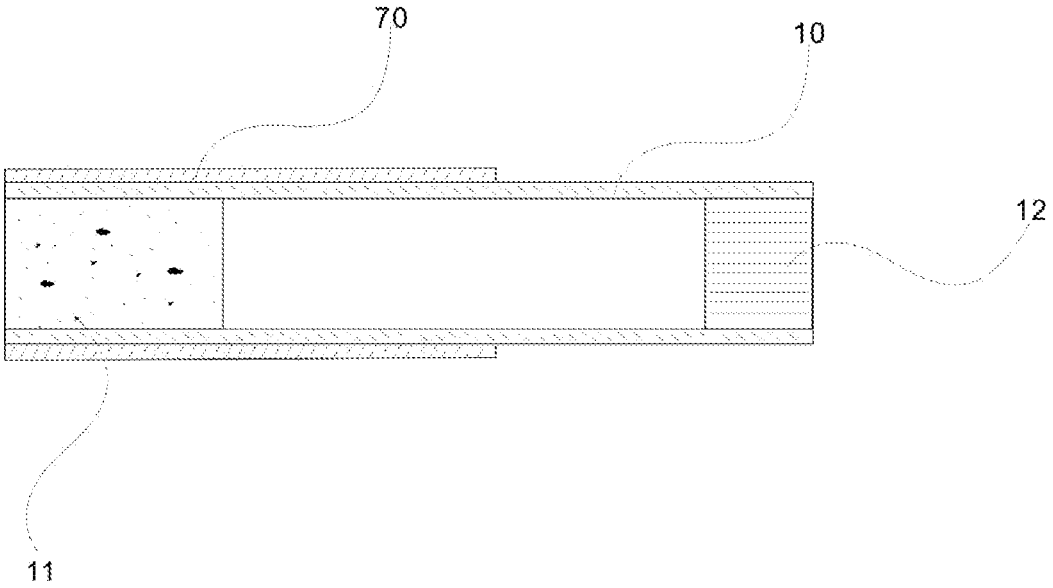
FIG. 13 illustrates a schematic diagram of another embodiment of the plastic part of the heat-not-burn product of the present disclosure.

Please refer to FIG. 8, which illustrates a schematic diagram of another embodiment of the heat-not-burn product of the present disclosure. As shown in FIG. 8, in this embodiment, a plastic part 30 which can be combined with the above embodiments is installed between the paste 11 and the capsule support 14. One end of the plastic part 30 is in contact with the paste 11, and the other end of the plastic part 30 is in contact with the capsule support 14 to secure the capsule 15. Please refer to FIG. 9 to FIG. 12; FIG. 9 to FIG. 12 illustrate schematic diagrams of different embodiments of the plastic parts of the heat-not-burn products of the present disclosure. As shown in FIG. 8 to FIG. 12, the material of the plastic part 30 is a cylindrical substrate processed by silica, plastic with high-temperature resistance or degradable polylactic acid. The outer edge of the cylindrical substrate is in contact with the inner wall of the hollow tube 10. The cylindrical substrate has a plurality of gas channels for the aerosol generated by the heated paste 11 to smoothly flow into the user's mouth through the plastic part 30, the capsule support 14 and the filter 12, when the heat-not-burn product of the present disclosure is heated, and the gas channels can be a plurality of circular or square channels or a single star channel as shown in FIG. 9 to FIG. 12. The proportion of the cross-section round area 31, 41, 51 and 61 of the gas channels 32, 42, 52 and 62 of the plastic part 30 is 1:2 to 1:10. Preferably, the proportion of the cross-section round area 31, 41, 51 and 61 of the gas channels 32, 42, 52 and 62 of the plastic part 30 is 1:3.

In addition, a small amount of tobacco leaf can also be added to the herbal material when the paste 11 is mixed in the present disclosure. The tobacco leaf in the paste 11 is the main source of nicotine. The nicotine in the tobacco leaf can be brought into the aerosol when the paste 11 is heated, so that the aerosol can pleasure the user. As the tea is used as the carrier of the paste 11, different proportion of the tea is added into the herbal material, and then the proportion of the tobacco leaf is different to get the paste 11 with different concentration of the nicotine. Of course, nicotine or nicotine salt can be added to the herbal material when the paste 11 is mixed; also, the nicotine or nicotine salt can be added to the surface of the paste 11 after the paste 11 is injected into the hollow tube 10, and the nicotine or nicotine salt on the surface of the paste 11 can also make the user satisfied because of the aerosol with nicotine or nicotine salt.

In addition, according to the functional needs of users, different material components can be added to the herbal materials or traditional Chinese medicines. For example, if an user has rhinitis, one or more compositions of *Centipeda minima, asarum, xanthium* fruit, wild *chrysanthemum*, menthol, mint leaf, borneol and the like can be added into the herbal material or traditional Chinese medicine. If an user has the symptoms of cough and bronchitis, one or more compositions of *stemona*, almond, *Cortex mori radicis,*

*Platycodon grandiflorum, Fritillaria cirrhosa, Houttuynia cordata*, forsythia, loquat leaf and the like can be added into the herbal material or traditional Chinese medicine. If an user has an uncomfortable throat, one or more compositions of tangerine, *gardenia*, liquorice, *Momordica grosvenori, Sterculia scaphigera* and the like can be added into the herbal material or traditional Chinese medicine. If an user has chronic pharyngitis, one or a combination of loquat leaf, *Momordica grosvenori*, honeysuckle, *Poria cocos, Sterculia scaphigera, Platycodon grandiflorum*, mint, liquorice, dandelion and the like can be added into the herbal material or traditional Chinese medicine. If an user needs nourishing function and health care, one or more compositions of *Cordyceps sinensis, ginseng, Ganoderma lucidum*, agilawood, American *ginseng*, pilose antler, *Eucommia ulmoides, Panax notoginseng* and *polygonatum* can be added into the herbal material or traditional Chinese medicine. If an user needs medical function and health care, one or more compositions of yew and jonquil can be added into the herbal material or traditional Chinese medicine. Even if an user wants to quit smoking, one or more compositions of *Houttuynia cordata*, earthworm, *Polygala tenuifolia, Agastache rugosus* and liquorice, or one or more compositions of radix pseudostellariae, mint, earthworm, *Houttuynia cordata, Polygala tenuifolia*, sodium bicarbonate and tea, or one or a combination of green tea, mint, *Agastache rugosus* and liquorice, or one or a combination of tea, honeysuckle, *chrysanthemum* wormwood leaf, *perilla*, lotus leaf, *Momordica grosvenori*, or one or more compositions of *Scutellaria barbata*, earthworm and garden burnet can be added into the herbal material or traditional Chinese medicine In addition, the water content of the paste 11 used in the above embodiments is more than that in the prior art, and the liquid spice flowing out of the capsule will leak into the surface of the hollow tube 10 after the capsule 15 is crumbed in the embodiments installed the capsule 15. Therefore, in this embodiment after the heat-not-burn products in the above embodiments are produced (as shown in FIG. 8), a layer of label paper 70 can be pasted on the surface of the hollow tube 10; before the hollow tube 10, the capsule support 14 and the filter 12 are connected, a layer of food grade quick drying glue is coated on the label paper 70, and then the hollow tube 10, the capsule support 14 and the filter 12 installed the capsule 15 inside are connected together with the label paper 70 to obtain the heat-not-burn product of the present disclosure. In some embodiments, the label paper 70 can also be with food grade self-adhesive glue on it, and then the hollow tube 10, capsule support 14 and the filter 12 installed the capsule 15 are connected together to obtain the heat-not-burn product of the present disclosure.

In the above embodiments, the label paper 70 comprises an impermeable paper and ink. The material of the label paper 70 is odorless, tasteless and non-toxic material, and the glue adhered to the product is selected from food grade quick drying glue or self-adhesive glue, which is harmless to human body during smoking; wherein the impermeable paper is 20-60 g/m$^2$. Preferably, the impermeable paper is 25-45 g/m$^2$, and the ink is food grade. The impermeable paper is pasted on the surface of the heat-not-burn product of the present disclosure, which can prevent the paste 11 from absorbing moisture in the air through the hollow tube 10 and the label paper 70 and becoming wet. The product will not breed bacteria or mildew to keep clean entirely because the liquid will not flow into the hollow tube 10. In addition, when the paste accounts for 100% of the length of the whole hollow tube 10, the paste 11, the capsule support 14, the capsule 15 or the filter 12 without capsule 15 can also be connected together through the label paper 70 to obtain the heat-not-burn product of the present disclosure.

Compared with the prior art, there are at least following advantages of the product of the present disclosure made by the manufacturing method of the heat-not-burn product:

1. Microwave or high-frequency wave has the characteristic of strong penetrability through substances. Therefore, using the microwave or high-frequency wave can simultaneously heat the inside and outside paste of the product, and meanwhile shorten the heating time to achieve the effect of uniform heating without any heat conduction process. In the situation of vacuum, the microwave or high-frequency wave can heat the paste to eliminate the its peculiar smell and make its taste soft. The paste is heated and formed together with the hollow tube. The produced product has a loose porous structure and suitable suction resistance, which the paste can be easily inserted into a heater to improve the users' experience. In addition, the microwave or high-frequency heating has a good germicidal effect.
2. Using of the microwave device or the high-frequency device has the advantages of small covering area and simple operation. It not only reduces the overall manufacturing cost, but also avoids a high-temperature environment. The present disclosure also has the advantages of no pollution and saving energy, and makes the products not easy to deteriorate and mildew and then conducive to long-term storage.
3. The suction resistance of the heat-not-burn non-tobacco or tobacco product is between 0.75-1.5 Kpa, which is consistent with the suction resistance of traditional light cigarettes, so that the heat-not-burn product can provide good suction resistance.
4. The heat-not-burn non-tobacco or tobacco product is smoked by heating at 200-300° C. When heated at 200-300° C., herbal material, traditional Chinese medicine or tobacco material will not be decomposed to tar and other harmful substances and be beneficial to physical and mental health.
5. Due to the water content in the paste accounts for 5 wt. %-10 wt. % and is low, the temperature of the aerosol generated by heating the paste in a heater is low and will not burn the user's mouth. At the same time, the liquid spice in the capsule can replenish aerosol flavor to the aerosol generated by heating the paste, which can pleasure the user.
6. The impermeable label paper is adhered on the surface of the heat-not-burn product of the present disclosure, which can prevent the paste from absorbing moisture in the air through the hollow tube 10 and becoming wet, and it will not cause the product to breed bacteria or mildew, and keep the product clean entirely.

It should be noted that the present disclosure is not limited to the above embodiments. According to the creative spirit of the present disclosure, those skilled in the art can also make other modifications, which should not be interpreted as limiting the scope of the present disclosure. It should be noted that all modifications and substitutions equivalent to the embodiment should be included in the scope of the present disclosure. Therefore, the scope of protection of the present disclosure shall be subject to the scope defined in the claims.

What is claimed is:

1. A manufacturing method of a heat-not-burn product, comprising the following steps:

providing a hollow tube, plant material, aerosol-forming agent and water;

mixing the plant material, the aerosol-forming agent and the water into a paste, and 35-60 parts by weight of water into the paste after mixing;

injecting the paste into the hollow tube from one end of the hollow tube by extrusion;

heating the paste by microwave in a microwave device, or heating the paste by high-frequency wave in a high-frequency device to obtain an expanded and fermented product;

drying the product, the paste of the product being formed into a loose porous structure with a porosity of 40%-75% in the hollow tube and reducing a suction resistance to 0.75-1.5 Kpa to make the aerosol pass smoothly and being integrally formed with the hollow tube, and the paste having a water content being between 5 wt. %-10 wt. %; and disposing a filter at the other end of the hollow tube to make the heat-not-burn product;

wherein the paste is expanded and adhered to an inner wall of the hollow tube in the heating step and is subsequently formed into the loose porous structure with the porosity of 40%-75% in the drying step.

2. The manufacturing method of a heat-not-burn product of claim 1, wherein heating power provided by the microwave device is 1 KW-100 KW, heating temperature provided by the microwave device is 30° C.-80° C., and heating time provided by the microwave device is 30-180 minutes.

3. The manufacturing method of a heat-not-burn product of claim 1, wherein heating frequency provided by the high-frequency device is 1 MHz-30 MHz, heating temperature provided by the high-frequency device is 30° C.-80° C., and heating time provided by the high-frequency device is 30-180 minutes.

4. The manufacturing method of a heat-not-burn product of claim 1, wherein the step of heating the paste by the microwave device or the high-frequency device is carried out in a situation of vacuum.

5. The manufacturing method of a heat-not-burn product of claim 1, wherein a drying temperature in the step of drying the product is 40° C.-80° C., and drying time is 100-400 minutes.

6. The manufacturing method of a heat-not-burn product of claim 1, wherein the paste before drying the product comprises from 30-80 parts by weight of the plant material, 5-10 parts by weight of tobacco spice, 5-20 parts by weight of tobacco extract, 5-50 parts by weight of the aerosol-forming agent, 0.01-5 parts by weight of adhesive, 0.01-1 parts by weight of expansion agent and 35-60 parts by weight of the water.

7. The manufacturing method of a heat-not-burn product of claim 1, wherein the plant material is ground in advance so that the plant material has a particle size of 40-200 mesh.

8. The manufacturing method of a heat-not-burn product of claim 1, wherein the paste accounts for 10%-100% of a length of the hollow tube.

9. The manufacturing method of a heat-not-burn product of claim 1, further comprising:

disposing a capsule support and a capsule filled with spice into the hollow tube in sequence before disposing the filter;

wherein the capsule support is installed along a center line of the paste and in contact with the paste;

wherein one end of the capsule is in contact with the capsule support and the other end of the capsule is in contact with the filter.

10. The manufacturing method of a heat-not-burn product of claim 9, wherein the capsule support is a coiled column shaped by winding a sheet;

wherein a plurality of layers are formed in a process of winding the sheet;

wherein there is a gap between the layers and a diameter of the capsule support is less than an inner diameter of the hollow tube;

wherein the capsule support is a hollow filter;

wherein an inner diameter of the hollow filter is less than an outer diameter of the capsule, so that the capsule is secured between the hollow filter and the filter.

11. The manufacturing method of a heat-not-burn product of claim 1, wherein the amount of paste in the hollow tube is controlled by injecting a predetermined amount in the injecting step;

wherein a length of the hollow tube is 12-18 mm and a length of the paste is 12-15 mm.

* * * * *